US008347590B2

(12) United States Patent
Goto

(10) Patent No.: US 8,347,590 B2
(45) Date of Patent: Jan. 8, 2013

(54) DEVICE FOR CUTTING PACKING BAG, DEVICE FOR PRODUCING PACKING BAG AND METHOD FOR PRODUCING PACKING BAG

(75) Inventor: Shuichi Goto, Tokyo (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 346 days.

(21) Appl. No.: 12/682,448

(22) PCT Filed: Oct. 10, 2008

(86) PCT No.: PCT/JP2008/068412

§ 371 (c)(1),
(2), (4) Date: Apr. 9, 2010

(87) PCT Pub. No.: WO2009/048118

PCT Pub. Date: Apr. 16, 2009

(65) Prior Publication Data

US 2010/0210439 A1 Aug. 19, 2010

(30) Foreign Application Priority Data

Oct. 12, 2007 (JP) ..... 2007-266841

(51) Int. Cl.
*B65B 43/04* (2006.01)

(52) U.S. Cl. ..... 53/455; 53/450; 53/452; 83/694

(58) Field of Classification Search ..... 53/550, 53/555, 450, 452, 455; 83/694, 684, 686; 493/239

See application file for complete search history.

(56) References Cited

U.S. PATENT DOCUMENTS

| | | | | |
|---|---|---|---|---|
| 3,748,205 | A * | 7/1973 | Adams | 156/252 |
| 4,216,639 | A * | 8/1980 | Gautier | 53/413 |
| 4,317,399 | A * | 3/1982 | Romagnoli | 83/237 |
| 5,181,365 | A * | 1/1993 | Garvey et al. | 53/455 |
| 5,408,807 | A * | 4/1995 | Lane et al. | 53/551 |
| 5,893,313 | A | 4/1999 | Mori | |

(Continued)

FOREIGN PATENT DOCUMENTS

JP 50-120084 A 9/1975

(Continued)

OTHER PUBLICATIONS

International Search Report of PCT/JP2008/068412 (Nov. 4, 2008).

*Primary Examiner* — Thanh Truong
(74) *Attorney, Agent, or Firm* — Millen, White, Zelano & Branigan, P.C.

(57) ABSTRACT

A cutter includes a male blade, a female blade, an advancement and retraction controller and a suction device. The male blade includes: a linear cutting portion linearly shaped with a predetermined thickness in a center part; a rounded cutting portion where a radius having a substantially arc shape in planar view is continuously formed from the linear cutting portion; and an end provided adjacent to the rounded cutting portion. The female blade has a fitting portion that is a hole conforming to the profile of the male blade in planar view and to which the male blade is fitted. On a lateral side of the female blade, an elongated hole for inserting a base film from one lateral side to the other lateral side is formed as an insertion portion.

7 Claims, 11 Drawing Sheets

U.S. PATENT DOCUMENTS

| | | | | |
|---|---|---|---|---|
| 6,109,154 | A * | 8/2000 | Miyatsu et al. | 83/627 |
| 6,374,715 | B1 * | 4/2002 | Takatsuka | 83/620 |
| 7,267,295 | B2 * | 9/2007 | Mead et al. | 241/283 |
| 7,685,798 | B2 * | 3/2010 | Marzocchi | 53/559 |
| 2007/0169878 | A1 * | 7/2007 | Tucker et al. | 156/220 |
| 2008/0041736 | A1 * | 2/2008 | Perrine | 206/204 |

FOREIGN PATENT DOCUMENTS

| | | | |
|---|---|---|---|
| JP | 56-113522 | A | 9/1981 |
| JP | 62-114897 | A | 5/1987 |
| JP | 02-225031 | A | 9/1990 |
| JP | 5-8330 | A | 1/1993 |
| JP | 07-069307 | A | 3/1995 |
| JP | 08-244142 | A | 9/1996 |
| JP | 09-070793 | A | 3/1997 |
| JP | 09-300486 | A | 11/1997 |
| JP | 2001-079964 | A | 3/2001 |
| JP | 2002-36392 | A | 2/2002 |
| JP | 2002-178418 | A | 6/2002 |
| JP | 2003-326616 | A | 11/2003 |
| JP | 2007-168798 | A | 7/2007 |

* cited by examiner

DEVICE FOR CUTTING PACKING BAG, DEVICE FOR PRODUCING PACKING BAG AND METHOD FOR PRODUCING PACKING BAG

TECHNICAL FIELD

The present invention relates to a cutter of a packaging bag having a seal portion on a periphery, a manufacturing device of the packaging bag and a manufacturing method of the packaging bag.

BACKGROUND ART

As a packaging material for packaging foods, pharmaceutical and medical products and groceries, a four-side-sealed packaging bag is known. Such a four-side-sealed packaging is provided by sealing two base films of a quadrangular bag body at four sides. The packaging bag has four sharp corners, which may hurt a hand or make runs in stockings and the like. Accordingly, a technique to cut the four corners in a substantially arc shape has been widespread.

For a manufacturing device of a packaging bag, an outline process in which devices are individually operated and an inline process in which devices are incorporated in a process line to manufacture a roll of packaging bags are available.

In the outline process, as shown in FIG. 10A, after sealing side seal portions 21 and a bottom seal portion 22 to form a quadrangular three-side-sealed packaging bag 1A, corners 11 on the side seal portions 21 and the bottom seal portion 22 are cut in two steps to form a packaging bag 1. Alternatively, as shown in FIG. 10B, after sealing the side seal portions 21 and the bottom seal portion 22 to form a quadrangular three-side-sealed packaging bag 1A, corners 11 on the side seal portions 21 and the bottom seal portion 22 are cut in one step to form a packaging bag 1. This outline process is time-consuming because of manual cutting and considerably costly because heavy equipment investment is required for using expensive machines.

In the inline process, as shown in FIG. 11A, in a base film 10 having a partition 181 sealed at every predetermined distances and partition 182 continuously sealed at one side, a part (chip 12) of the partition 181 is firstly cut off to form a rounded portion 13. Subsequently, the base film is cut along a straight line L located near a center part of the partition 181. As shown in FIGS. 11B and 11C, as a result of such a two-step operation, the straight line L and an end of the rounded portion 13 are not aligned to unfavorably form a protrusion P.

Accordingly, according to a technique, two cutting lines are provided and are respectively cut with two blades, thereby avoiding protrusion formation.

As disclosed in Patent Document 1, another technique using a blade capable of integrally forming four corners and a straight line of a packaging bag and cutting the four corners and the straight line in a one-step operation is also known.

[Patent Document 1] JP-A-05-8330

DISCLOSURE OF THE INVENTION

Problems to be Solved by the Invention

However, when cutting lines are respectively cut off by two blades, cut-off chips have cling to the blades with static, thereby deteriorating operation efficiency. Though the chips are to be removed by air treatment, the chips cannot be removed completely. In addition, a very expensive machine needs to be introduced as an equipment to cut the two straight lines individually, which costs considerably.

In a device as disclosed in Patent Document 1, since a blade is thin like a cutting knife, a receiving portion should be softer than the blade. For instance, the receiving portion is made of plastic or rubber. Accordingly, the receiving portion needs regular exchange, which consumes time and invites cost. Moreover, cutting with a thin blade is likely to cause poor cutting.

Accordingly, an object of the present invention is to provide: a cutter for a packaging bag that requires low equipment cost, exhibits a favorable cutting performance and reliably manufactures a packaging bag having a predetermined shape; a manufacturing device of the packaging bag; and a manufacturing method of the packaging bag.

Means for Solving the Problems

A cutter according to an aspect of the invention is a cutter for a packaging bag, including a male blade that includes: a linear cutting portion having a predetermined thickness and substantially linearly shaped in planar view; and a rounded cutting portion substantially arc-shaped in planar view and continuously formed from the linear cutting portion; and a female blade formed in a substantially rectangular parallelpiped and including a fitting portion that is formed of the same profile as the male blade and penetrates from one surface to the other opposing surface of the female blade, in which the male blade is advanced/retracted along the fitting portion.

The packaging bag is formed, for instance, by sealing superposed base films.

According to the above aspect of the invention, the base film is supplied to the female blade while the male blade is not fitted to the female blade and the male blade is fitted to the fitting portion of the female blade. In fitting of the male blade, on the moment when a tip of the male blade and both walls of the fitting portion of the female blade contact with each other, the base film therebetween is cut. In other words, the base film is cut based on the scissors principle. The cut edge cut by the male blade is formed in a shape of the male blade due to its thickness.

Accordingly, since the base film is cut by a predetermined thickness in one step, no protrusion is formed even though a cutting position is deviated. In other words, a packaging bag having a high quality can be provided.

Moreover, no cutting defect is likely to occur because the base film is cut based on the scissors principle.

Furthermore, the base film is cut by the linear cutting portion and four corners of the packaging bag is cut in a substantially arc by the rounded cutting portion, thereby simplifying the operation process.

The cutter of this structure can be manufactured at low cost, thereby reducing cost for introducing equipment.

In the cutter of the aspect of the invention, it is preferable that the linear cutting portion and the rounded cutting portion of the male blade are integrally formed.

According to the aspect of the invention, since the linear cutting portion and the rounded cutting portion are integrally controllable, time and effort during the operation process are avoidable. In other words, operation efficiency is favorable.

In the cutter for the packaging bag according to the aspect of the invention, the female blade further preferably includes an insertion portion that is perpendicular to the fitting portion and penetrates from one lateral surface to the other opposing lateral surface of the female blade, and the fitting portion includes: a guide portion that guides the male blade; and a cutting portion that is provided adjacent to the guide portion with the insertion portion interposed therebetween.

In the aspect of the invention, the base film is supplied to the insertion portion and is cut by advancing/retracting the male blade within the fitting portion perpendicular to the insertion portion. The fitting portion is provided with the guide portion and the cutting portion.

In the aspect of the invention, the male blade is advanced/retracted along the guide portion. At the moment when the tip of male blade and the cutting portion intersect to each other for the first time, the base film located therebetween is cut.

Since the guide portion is formed integrally with the female blade, the male blade can be accurately advanced/retracted. Accordingly, the male blade and the cutting portion are also accurately fitted to each other, so that the base film is reliably cut on the moment when the male blade and the cutting portion intersect to each other, thereby providing a cutter exhibiting a favorable cutting performance and high accuracy.

It is preferable that the male blade constantly remains inserted in the guide portion of the female blade in terms of high accuracy.

In the cutter for the packaging bag according to the aspect of the invention, a suction device for sucking chips is preferably provided on a side of the female blade opposite to a side where the male blade is located.

The male blade is inserted from one end of the fitting portion of the female blade. Chips cut within the female blade are pushed by the male blade to be ejected to the other end of the female blade.

According to the aspect of the invention, the male blade ejects the chips along the fitting portion of the female blade and the ejected chips are sucked by the suction device. Thus, the chips are disposed of reliably. Since the chips do not cling to a surrounding device and the base film with static or the like, operation can efficiently be carried out.

In the cutter for the packaging bag according to the aspect of the invention, a tip of the male blade is preferably tapered, so that a diameter of the male blade is reduced at every predetermined interval.

According to the aspect of the invention, the tip of the male blade is tapered, thereby improving the cutting performance in cutting the base film.

A manufacturing device of a packaging bag according to another aspect of the invention includes: a sealer for sealing a base film to form a partition; and the cutter for the packaging bag that cuts the partition.

According to the above aspect of the invention, the partition is formed by sealing the base films by the sealer. The partition is to be a side seal portion or a bottom seal portion when the base film is cut at the partition and a single packaging bag is formed. For instance, the partitions are formed at three sides of the base film for obtaining a three-side-sealed packaging bag. The three sides, herein, are parts corresponding to three sides except an opening of a quadrangular packaging bag obtained from the base film.

The sealed base film is supplied to the above cutter, where the base film is cut at every partition by fitting of the male blade and the female blade of the cutter, and a single packaging bag is provided.

Thus, the manufacturing device of the packaging bag, which includes the above cutter, can provide the same advantages as the above.

A manufacturing method of a packaging bag according to still another aspect of the invention, using the manufacturing device of the packaging bag, sealing the base film by the sealer to form a partition; supplying the base film to the female blade of the cutter for the packaging bag; and advancing/retracting the male blade at every partition.

According to the above aspect of the invention, for instance, three sides of the base film are sealed by the sealer to form the partition, followed by supplying the base film to the female blade and advancing/retracting the male blade along the fitting portion of the female blade. Thus, the manufacturing method, in which the base film is cut by the above cutter, can provide the same advantages as the above. Particularly, a packaging bag of high quality in which no protrusion is formed at a cut edge is obtained and cost can be reduced by introducing an inexpensive cutter.

BEST MODE FOR CARRYING OUT THE INVENTION

Embodiments of the present invention will be described below with reference to the attached drawings.

[1. Structure of Packaging Bag 100]

Figure 1:
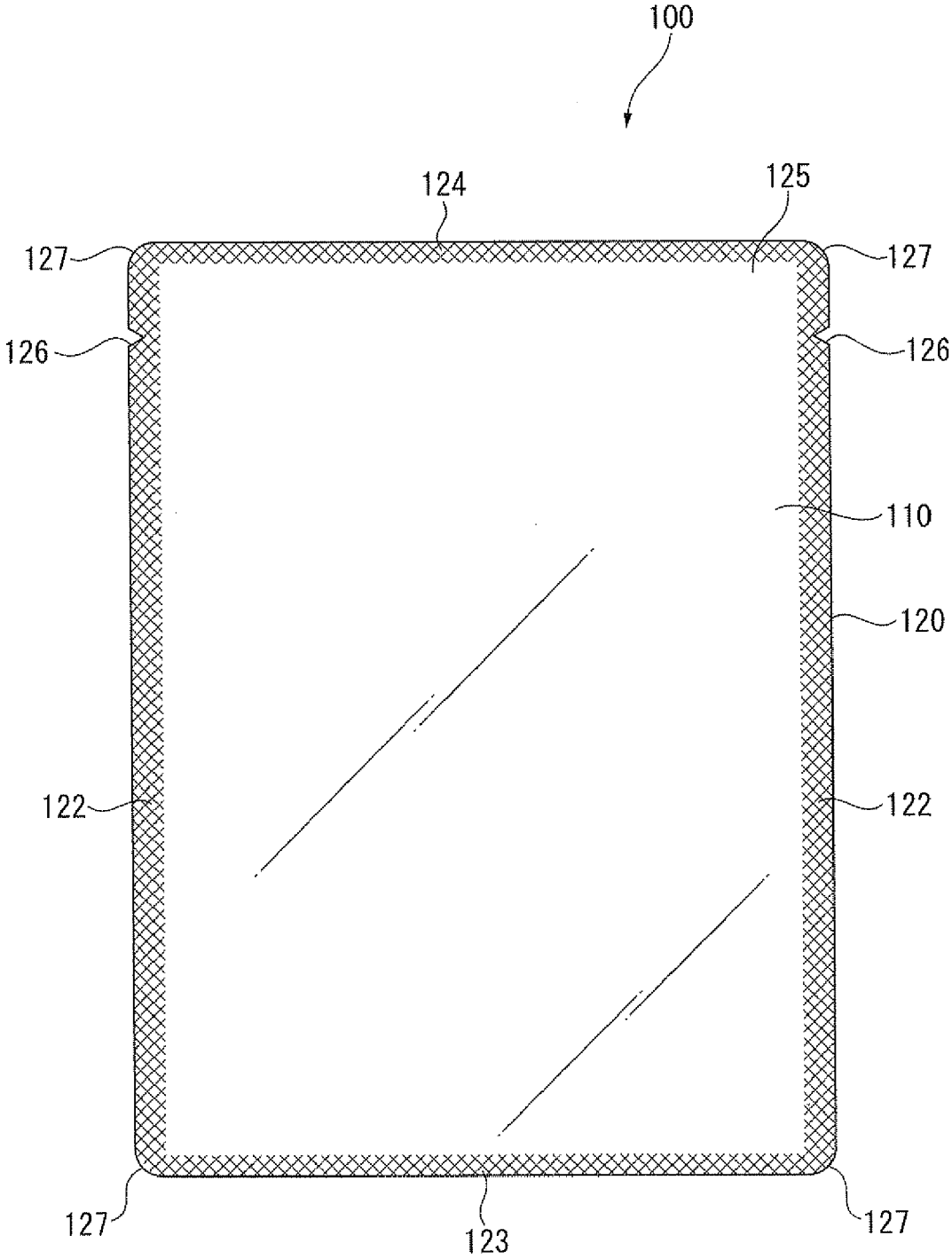
FIG. 1 is a front view of a packaging bag according to an exemplary embodiment of the invention.

FIG. 1 is a front view of a packaging bag according to an exemplary embodiment of the invention.

As shown in FIG. 1, a packaging bag 100 includes: a bag body 120 that is obtained by superposing base films 110 as a packaging material and forming side seal portions 122, a bottom seal portion 123 and a top seal portion 124 on the periphery of the base films; a notch 126 provided on the side seal portions 122 closer to an opening 125 of the bag body 120; and rounded portions 127 formed in a substantially arc at four corners of the bag body 120.

The base film 110 may be: a film made of polyethylene terephthalate (PET), nylon (Ny) and cast polypropylene (CPP); a film made of PET, aluminum (AL) foil and CPP; a film made of PET, Ny and L-LDPE; a transparent vapor-deposited film made of PET and L-LDPE; or a film made of Ny, ethylene vinyl alcohol (EVOH) and L-LDPE. In addition, polypropylene (PP) sheet, multilayer sheet made of polyethylene (PE) and polystyrene (PS), thermal molding product of a multilayer sheet made of Ny and PE may be used as the base film 110.

The packaging bag 100 as structured above is torn apart from the notch 126 for opening. A shape of the notch 126 is not particularly limited, and may include V-shape and substantially semielliptic shape.

A content is fed in a three-side sealed packaging bag and subsequently the top seal portion 124 is sealed, thereby providing the packaging bag 100.

[2. Structure of Manufacturing Device 200]

Figure 2:
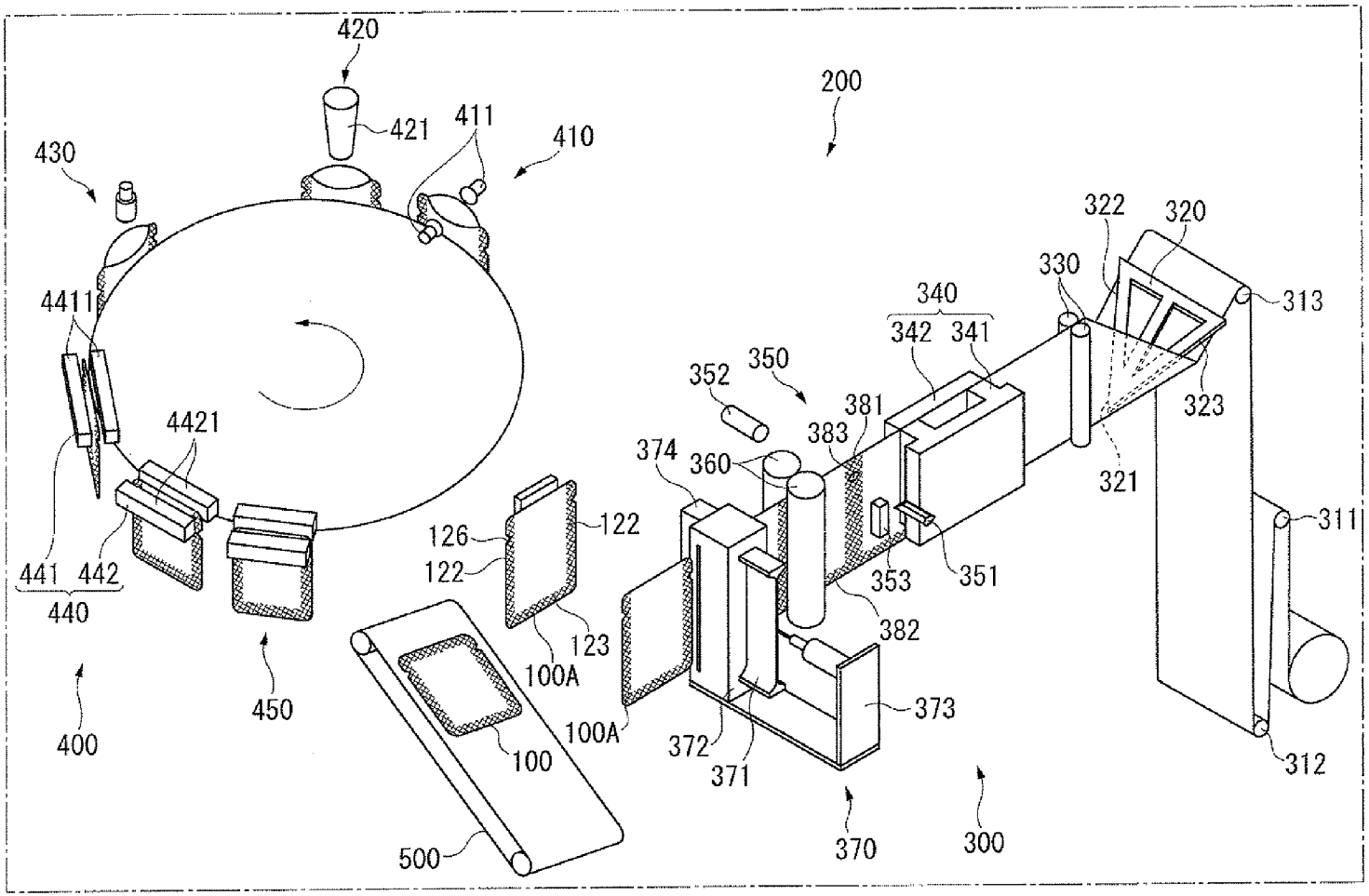
FIG. 2 is a schematic view of a manufacturing device of the packaging bag according to the exemplary embodiment of the invention.

FIG. 2 is a schematic view of a manufacturing device of the packaging bag according to the exemplary embodiment of the invention.

As shown in FIG. 2, the manufacturing device 200 includes: a bag-forming device 300 to manufacture a packaging bag 100A sealed the side seal portions 122 and the bottom seal portion 123 (sealed at three sides); a filling device 400 to complete the packaging bag 100 by forming the top seal portion 124 after filling the content in the packaging bag 100A sealed at three sides.

[2-1. Structure of Bag-Forming Device 300]

A bag-forming device 300 includes: rollers 311, 312 and 313 for feeding the base film 110; a triangle plate 320 for bending the base film 110; a joint roller 330; a sealer 340; a notch-forming device 350; a feed roller 360 and a cutter 370.

The rollers 311 and 312, around which the base film 110 is previously wound, feed the base film 110. The roller 313 supports the base film 110.

The triangle plate 320 bends at a center line a single piece of the base film 110 continuously supplied from the rollers 311, 312 and 313 to double the base film. The triangle plate 320 is disposed so that a top 321 of the triangle plate 320 is positioned along the center line of the base film 110 in an advancing direction.

The joint roller 330 superposes the base film 110 bent by the triangle plate 320.

The sealer 340 includes seal bars 341 and 342 that are disposed opposing each other with the base film 110 interposed therebetween. The seal bar 341 has a square C-shaped pressing-face so as to form a partition 381 that corresponds to the side seal portion 122 of the packaging bag 100 and a partition 382 that corresponds to the bottom seal portion 123 of the packaging bag 100. In contrast, the seal bar 342 has a flat pressing-face. However, the seal bar 342 may have a square C-shaped pressing-face similarly to the seal bar 341.

The sealer 340 welds two base films 110 by sealing the two base films 110 from both sides.

The notch-forming device 350 includes: a notch-forming portion 351; a notch-forming support 352 and a mark detection phototube 353. When the mark detection phototube 353 detects the partition 381, the notch-forming portion 351 and the notch-forming support 352 operate to form a substantially rhombus-shaped hole in the partition 381 near the opening 125. The notch-forming portion 351 may have a shape corresponding to a shape of a notch to be formed.

The feed roller 360 supports the base film 110 continuously supplied.

Figure 3:
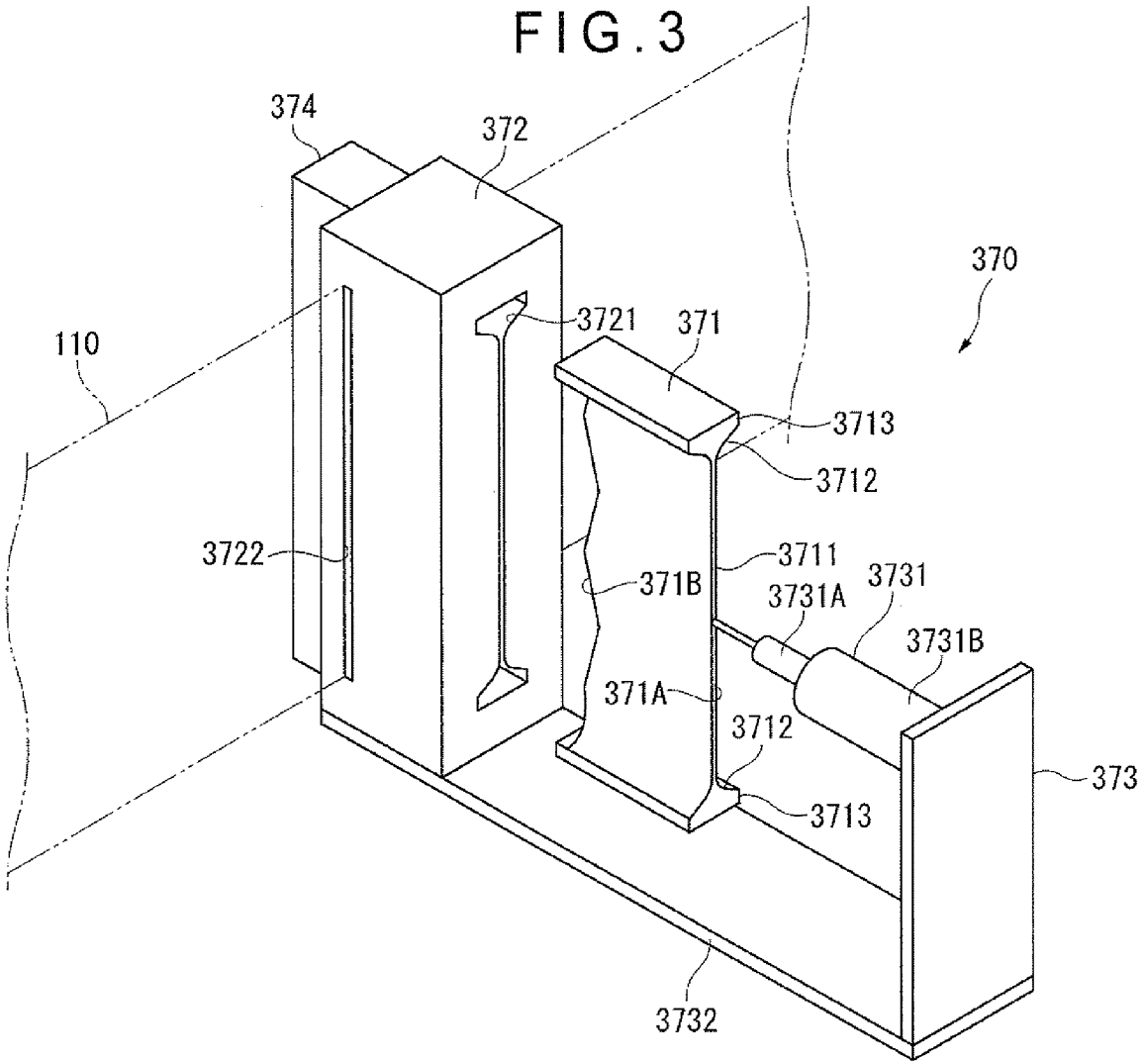
FIG. 3 is a schematic view of a cutter according to the exemplary embodiment of the invention.

FIG. 3 is a schematic view of a cutter according to the exemplary embodiment of the invention.

As shown in FIG. 3, the cutter 370 includes: a male blade 371; a female blade 372; an advancement and retraction controller 373 that controls the male blade 371 to advance and retract; and a suction device that sucks a chip produced by the male blade 371 and the female blade 372.

As shown in FIG. 2, the male blade 371 is typically kept inserted in a fitting portion 3721 of the female blade 372. However, in FIG. 3, the male blade 371 is not inserted in the fitting portion 3721 for explanation.

Figure 4A:
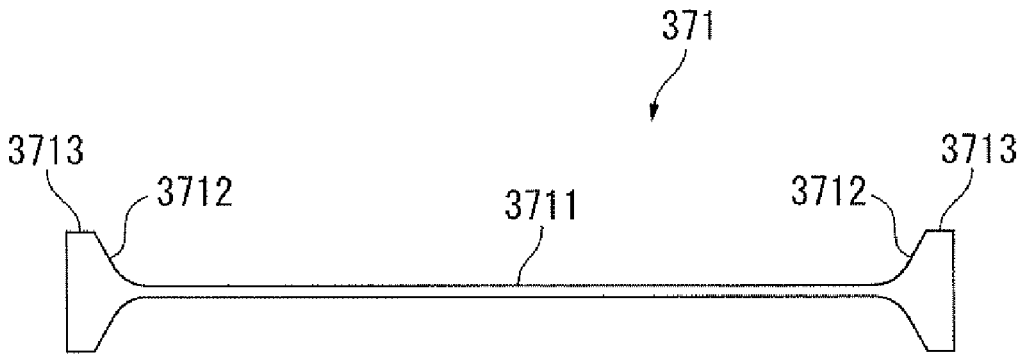
FIG. 4A is a plan view of a male blade according to the exemplary embodiment of the invention.
Figure 4B:
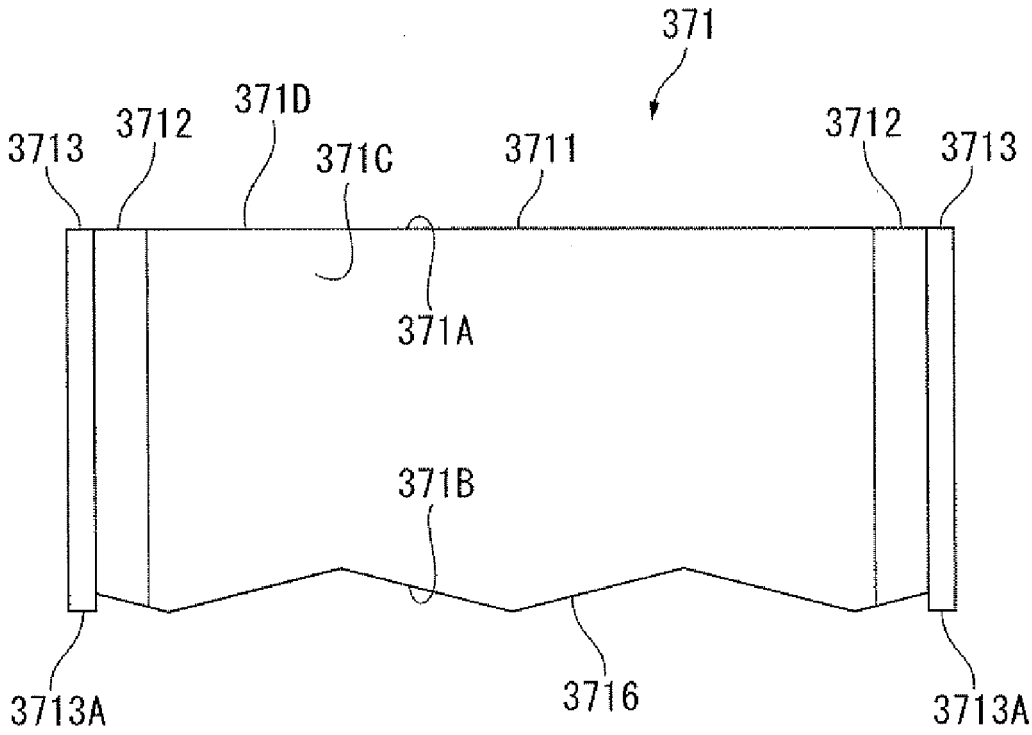
FIG. 4B is a side view of the male blade according to the exemplary embodiment of the invention.

FIG. 4A is a plan view of the male blade of the exemplary embodiment of the invention. FIG. 4B is a side view of the male blade of the exemplary embodiment of the invention.

As shown in FIG. 4A, the male blade 371, which is elongatedly formed in planar view, includes: a linear cutting portion 3711 linearly shaped with a predetermined thickness and located in a center part; an end 3713 that is thicker than the linear cutting portion 3711; and a rounded cutting portion 3712 formed continuously from the linear cutting portion 3711 to the end 3713 to define a substantially arc shape in planar view to have a curve (R).

The thickness of the linear cutting portion 3711 is preferably small in teens of reducing cut-off parts, for instance from 1.0 mm to less than 1.7 mm. When the thickness of the linear cutting portion 3711 is less than 1.0 mm, accuracy of a fitting between the male blade 371 and the female blade 372 may not be maintained. When the thickness of the linear cutting portion 3711 is 1.7 mm or more, cut-off parts are increased.

The curve (R) of the rounded cutting portion 3712 may be set according to a size of the packaging bag 100.

The end 3713, which supports the entirety of the male blade 371, has a thickness in accordance with the curve of the rounded cutting portion 3712.

As shown in FIGS. 3 and 4B, an upper surface 371A of the male blade 371 is formed to be coplanarly flat. On the other hand, a lower surface 371B is tapered so that diameters of the linear cutting portion 3711 and the rounded cutting portion 3712 are reduced in a direction toward the upper surface 371A at every predetermined interval. In the exemplary embodiment, the diameters are reduced approximately twice so that the lower surface 371B approaches the upper surface 371A approximately twice, but the arrangement is not limited thereto. The smaller the intervals for reducing the diameters becomes, the more the cutting performance is preferably enhanced. However, it is not easy to form the male blade 371 in such a shape. The shape of the male blade 371 may be selected by balancing cutting performance and easiness of manufacturing the male blade 371.

Figure 6:
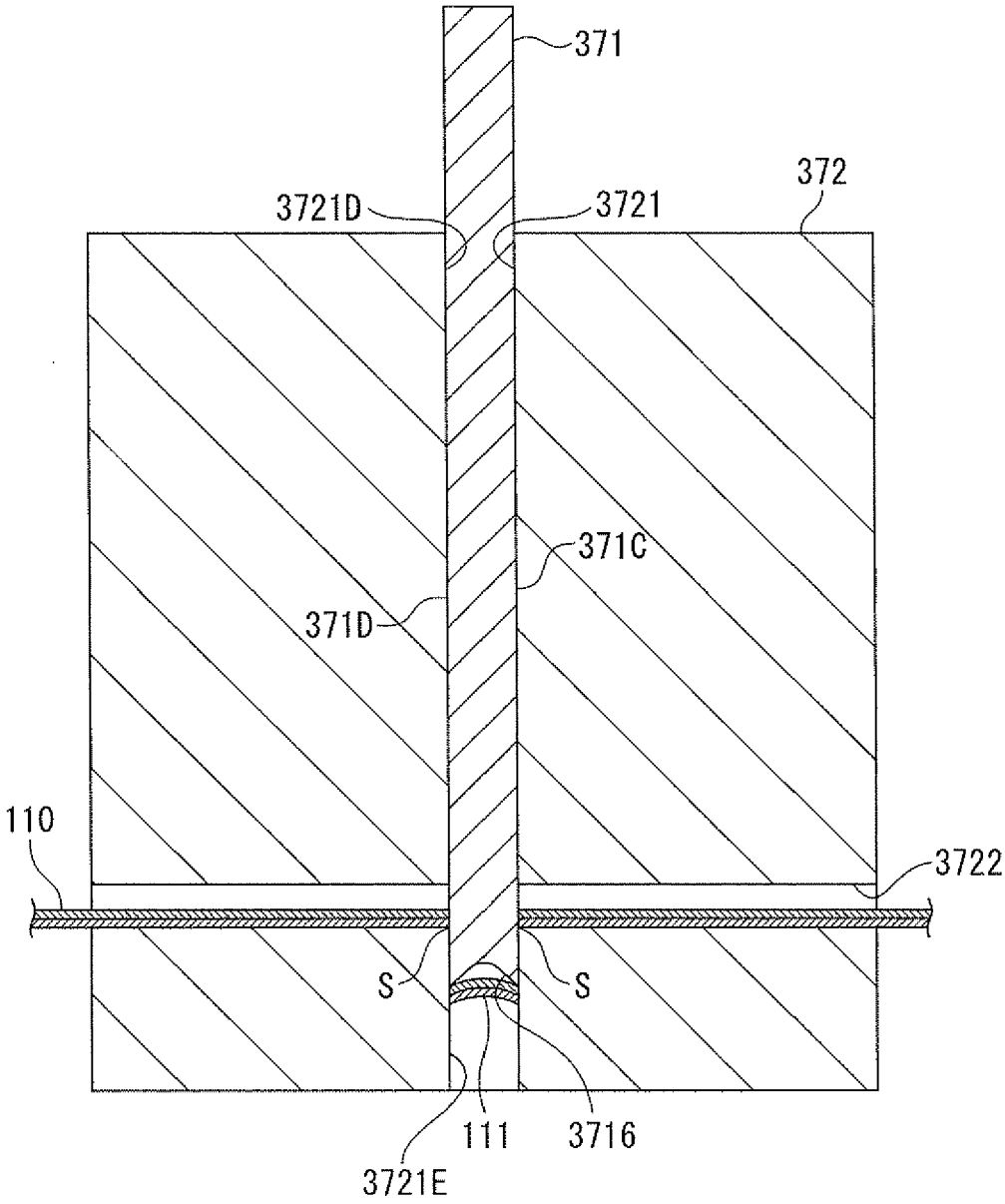
FIG. 6 is a cross sectional view showing how the male blade and the female blade are fitted to each other according to the exemplary embodiment of the invention.

On the linear cutting portion 3711 and the rounded cutting portion 3712 of the lower surface 371B, edges 3716 are formed along edges of both walls 371C and 371D of the male blade 371 (see FIG. 6). A lower surface 3713A of the end 3713 is flat.

A length between the upper surface 371A and the lower surface 3173A is not particularly limited, but is required to be enough for keeping accuracy of the fitting between the male blade 371 and the female blade 372. The female blade 372, which will be described later, is preferably configured such that, when the male blade 371 is inserted in a guide portion 3721D of the female blade 372, only a tip of the end 3713 enters a cutting portion 3712E. With this arrangement, the male blade 371 is reliably fitted to the cutting portion 3721E, However, when the guide portion 3721D is formed integrally with the female 372 as in this exemplary embodiment, the arrangement is not limited to the above because such integration exhibits high accuracy.

Figure 5A:
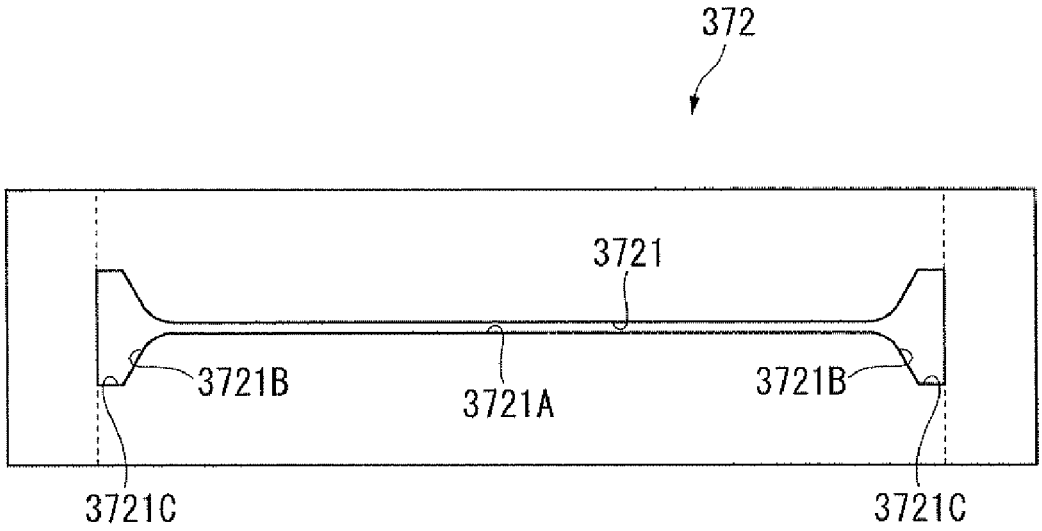
FIG. 5A is a plan view of a female blade according to the exemplary embodiment of the invention.
Figure 5B:
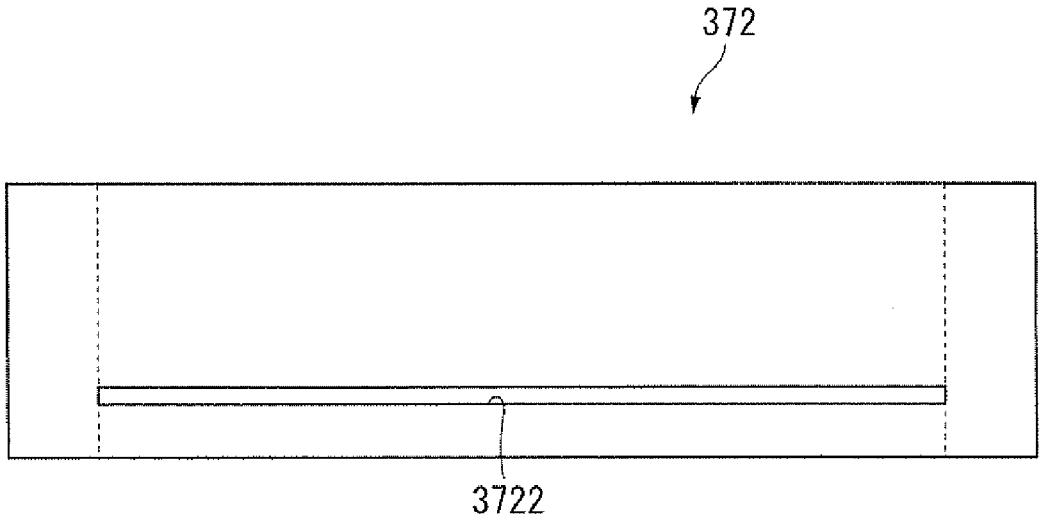
FIG. 5B is a side view of the female blade according to the exemplary embodiment of the invention.

FIG. 5A is a plan view of the female blade of the exemplary embodiment of the invention. FIG. 5B is a side view of the female blade of the exemplary embodiment of the invention.

The female blade 372, which is formed in a substantially rectangular parallelepiped, includes a fitting portion 3721 that penetrates the rectangular parallelepiped from one surface to the other opposing surface and to which the male blade 371 is fitted. The fitting portion 3721 includes: a linear fitting portion 3721A having a predetermined thickness in planar view; an end fitting portion 3721C thicker than the linear fitting portion 3721A; and a rounded fitting portion 3721B formed continuously from the linear fitting portion 3721A to the end fitting portion 3721C to define a substantially arc shape in planar view and to have a curve (R). The linear fitting portion 3721A is fitted to the linear cutting portion 3711 of the male blade 371. The rounded fitting portion 3721B is fitted to the rounded cutting portion 3712 of the male blade 371. The end fitting portion 3721C is fitted to the end 3713 of the male blade 371. In other words, the fitting portion 3721 is a hole that conforms to the profile of the male blade 371, so that the male blade 371 can be fitted therewith.

As shown in FIG. 5B, on a lateral surface of the female blade 372, an elongated hole is formed as an insertion portion 3722. The insertion portion 3722 penetrates from one lateral surface to the other lateral surface, through which the base film 110 is inserted from one lateral surface to the other lateral surface.

As described above, the fitting portion 3721 and the insertion portion 3722 penetrate the female blade 372 in directions perpendicular to each other.

As shown in FIG. 6, the fitting portion 3721 is divided into: the guide portion 3721D for guiding the male blade 371; and the cutting portion 3721E for cutting the base film 110, with the insertion portion 3722 interposed therebetween. The guide portion 3721D is preferably longer than the cutting portion 3721E in terms of improving accuracy.

Materials for forming the male blade 371 and the female blade 372 as described above are not particularly limited. The materials may be the same or different. Examples of the materials include iron, alloys and plastics, but alloys are preferably used in terms of excellent durability and wear resistance.

As shown in FIG. 3, the advancement and retraction controller 373 includes: a cylinder 3731; and a support 3732 supporting the female blade 372 and the cylinder 3731. A tip 3731A of the cylinder 3731 is connected to the male blade 371. A body 3731B of the cylinder 3731 is connected to the support 3732. The support 3732 is integrally formed with the female blade 372.

The advancement and retraction controller 373 with this arrangement can control advancement and retraction of the male blade 371 by advancing and retracting the tip 3731A of the cylinder 3731.

An arrangement of the advancement and retraction controller 373 is not particularly limited, as long as the advancement and retraction controller 373 integrally supports the male blade 371 and the female blade 372 and advances/retracts the male blade 371.

The suction device 374, which is provided on the female blade 372 opposite to the side where the male blade 371 advances/retracts, sucks chips produced in cutting. For instance, a vacuum suction device is usable.

[2-2. Structure of Filling Device 400]

As shown in FIG. 2, a filling device 400 includes: an opening device 410 to open the opening 125 of the three-side-sealed packaging bag 100A; a filling device 420 to fill the bag with a content through the opening 125; a seal opening washer 430 to wash an inside of the opening; a sealer 440; and a cooler 450. These elements are disposed along substantially circular orbit. During the operation, the packaging bag 100A is moved step by step from one element to another.

The opening device 410 includes grips 411. Each of the grips 411 grips the base film 110 at a position closer to the opening 125 of the packaging bag 100A, and opens the packaging bag 100A in an opening direction.

The filling device 420 includes a pouring funnel 421 for filling the content. The pouring funnel 421 is inserted in the opening 125 of the packaging bag 100A and the content is fed in the packaging bag 100A.

The seal opening washer 430 washes the inside of the base film 110 where the top seal portion 124 is formed.

The sealer 440 includes a first sealer 441 and a second sealer 442, which have seal bars 4411 and 4422 respectively. A sealing temperature of the first sealer 441 and the second sealer 442 may be selected in accordance with a type, grade and thickness of a resin used as the base film 110 and a processing rate.

Sealing in two steps as described above allows for quick processing, thereby providing high productivity and stabilizing the sealing portion.

The cooler 450 cools the top seal portion 124 heated by the seal bars 4411 and 4421, which solidifies the top seal portion 124, thereby enhancing sealing strength.

The cooler 450 is followed by a conveyor 500 that ejects a completed packaging bag 100.

[3. Operation of Manufacturing Device 200]

Operation of the manufacturing device 200 will be described below.

A single piece of the base film 110 is continuously supplied to the bag-forming device 300 through the rollers 311, 312 and 313. The base film 110 is advanced along two sides 322 and 323 extending from the top 321 of the triangle plate 320 and is bent at the top 321 as a base point. The bent base film is superposed by the joint roller 330.

Next, the base film 110 is supplied to the sealer 340 and sealed from the both sides by seal bars 341 and 342, thereby forming the partitions 381 and 382.

In the notching-forming device 350, when the mark detection phototube 353 detects the partition 381, the notch-forming portion 351 and the notch-forming support 352 are activated to form a substantially rhombus-shaped hole 383 on the partition 381.

Subsequently, the base film is supported by the feed rollers 360 and supplied to the cutter 370.

In the cutter 370, the base film 110 is introduced from one side of the insertion portion 3722 of the female blade 371 and is ejected from the other side thereof. The male blade 371 stands by while being kept inserted in the guide portion 3721D. At this time, a tip of the male blade 371 is disposed at such a position as not to reach the insertion portion 3722. The male blade 371 is advanced along the guide portion 3721D at every predetermined interval by the cylinder 3731, thereby being fitted to the cutting portion 3721E. The predetermined interval is decided in accordance with moving distance of the base film 110. The male blade 371 is advanced/retracted at every length of the opening 125 of the packaging bag 100, so as to cut a center part of the partition 381. The interval is determined in consideration of a width of a chip cut by the cutter 370 in addition to the length of the opening 125 of the packaging bag 100.

FIG. 6 is a cross sectional view showing how the male blade and the female blade are fitted to each other according to the exemplary embodiment of the invention.

As shown in FIG. 6, the male blade 371 is advanced along the guide portion 3721D to intersect the insertion portion 3722. At this time, when the edges 3716 of the male blade 371 intersect the cutting portion 3721E of the female blade 372, the base film 110 is cut at two cutting points S. Chips 111 thus cut are extruded by the male blade 371 and sucked by the suction device 374 (see FIG. 3).

Thus, the base film 110 introduced from the one side of the insertion portion 3722 of the female blade 372 is cut within the female blade 372. When ejected from the other side of the insertion portion 3722, the base film 110 is provided as the packaging bag 100A that is three-side-sealed at the side seal portions 122 and the bottom seal portion 123.

The obtained packaging bag 100A is supplied one-by-one to the filling device 400 by a transferring device (not shown).

In the device 400, firstly, the grips 411 of the opening device 410 respectively grip the opposing base films 110 at a position closer to the opening 125 of the packaging bag 100A, thereby opening the opening 125 in a direction to separate the base films from each other.

Next, the opened packaging bag 100A is transferred to the filling device. The pouring funnel 421 is inserted in the opened opening 125 and a predetermined amount of the content is fed thereinto.

The packaging bag 100A in which the content is fed is transferred to the seal opening washer 430, where the inside of the base film 110 closer to the opening 125 is washed, and then is transferred to the sealer 440.

The packaging bag 100A is sealed at 160 degrees C. by the first sealer 441 and the second sealer 442 to form the top seal portion 124. Subsequently, the top seal portion 124 is cooled by the cooler 450 to be stabilized. The sealing temperature may be adjusted in accordance with a material, thickness and the like of the base film 110.

Consequently, the sealed packaging bag 100 in which the content is fed is mounted on the conveyor 500 to be ejected out of the manufacturing device 200.

[4. Advantages of Embodiment]

The above exemplary embodiment has the following advantages.

(1) In the exemplary embodiment, the male blade 371 including the linear cutting portion 3711 of the predetermined thickness; and the female blade 372 fitted to the male blade 371 are provided. The male blade 371 is advanced/retracted in a direction perpendicular to the base film 110 inserted in the insertion portion 3722 of the female blade 372 to be fitted to the female blade 372. At this time, the base film 110 is cut at two cutting points S where the edges 3716 of the male blade 371 intersect the cutting portion 3721E of the female blade 372. As described above, since the partition 381 of the base film 110 is cut with a thickness of the linear cutting portion 3711 of the male blade 371, no protrusion is formed at a cut edge even when a cutting position is slightly deviated. In other words, a packaging bag having a high quality can be provided.

(2) The base film 110 is cut when the male blade 371 and the female blade 372 are fitted together: i.e., the base film 110 is cut based on the so-called scissors principle. Thus, the cutting performance is favorable.

(3) Further, the cutter 370, which includes the male blade 371, the female blade 372, the advancement and retraction controller 373 and the suction device 374, can be manufactured at low cost, thereby reducing cost for introducing such equipments.

(4) In the exemplary embodiment, since the linear cutting portion 3711 of the male blade 371 and the rounded cutting portion 3712 are integrally formed, the linear cutting portion 3711 and the rounded cutting portion 3712 are simultaneously controllable.

Accordingly, since the linear cutting portion 3711 and the rounded cutting portion 3712 are integrally controllable, time and effort in the operation process are savable. In other words, operation efficiency is favorable.

(5) The guide portion 3721D for guiding the male blade 371 is integrally formed with the female blade 372. Accordingly, by advancing/retracting the male blade 371 along the guide portion 3721D, the male blade 371 can reliably be fitted to the cutting portion 3721E of the female blade 372. Consequently, the base film can reliably be cut at the cutting points S. Further, cutting performance is favorable. Thus, a cutter of a high accuracy can be provided.

(6) The suction device 374 reliably disposes of chips 111 cut off in the female blade 372 by sucking the chips 111. Accordingly, the chips 111 do not cling to the cutter 370 and the base film 110 with static or the like, thereby efficiently carrying on manufacturing process.

(7) In the exemplary embodiment, the lower surface 371B of the male blade 371 is tapered so that the diameter of the male blade 371 is reduced in the direction toward the upper surface 371A at every predetermined interval. Accordingly, cutting performance can be improved when the lower surface 371B cuts the base film 110 by contacting therewith.

(8) In the exemplary embodiment, the base film 110 can be cut at the two cutting points S by fitting the thick male blade 371 to the female blade 372. In other words, two cutting lines can be formed in one processing.

Since only one processing is required, the two cutting lines are not positioned incorrectly. Moreover, since only one cutter is required, an inexpensive manufacturing device can be provided.

[5. Modification(s) of Embodiment]

Incidentally, the scope of the present invention is not limited to the above-described embodiments but also includes modifications and improvements as long as an object of the invention can be achieved.

Figure 7A:
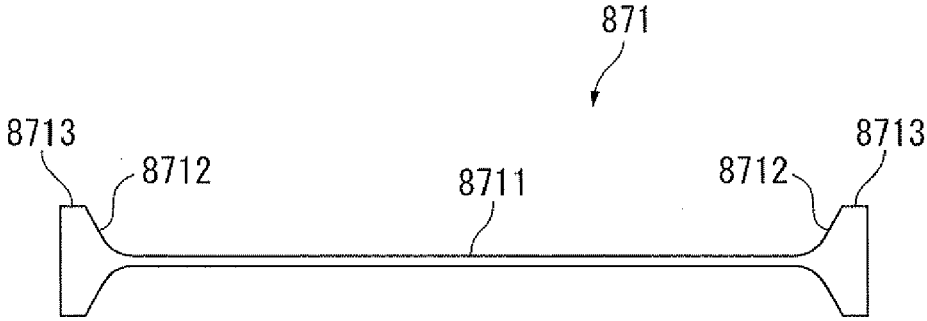
FIG. 7A is a plan view of a male blade according to a modification of the invention.
Figure 7B:
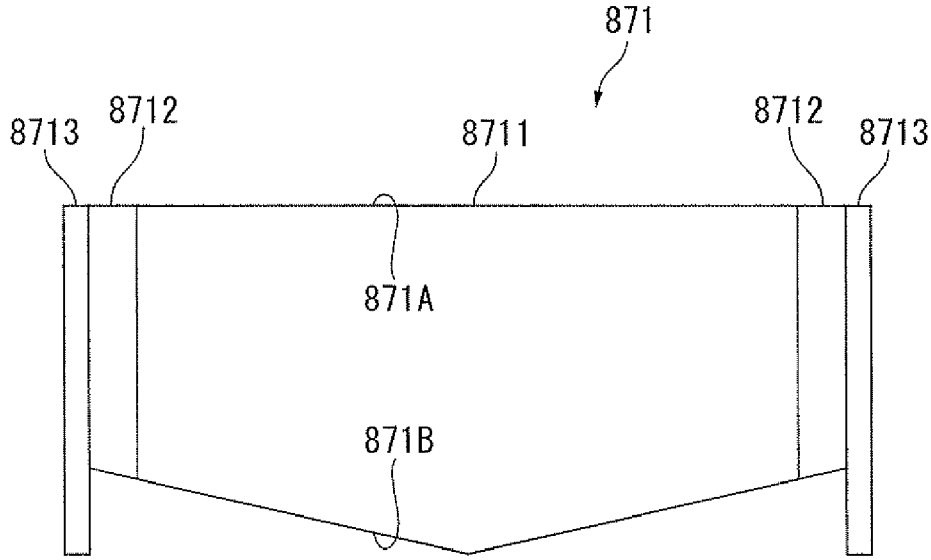
FIG. 7B is a side view of the male blade according to the modification of the invention.
Figure 8A:
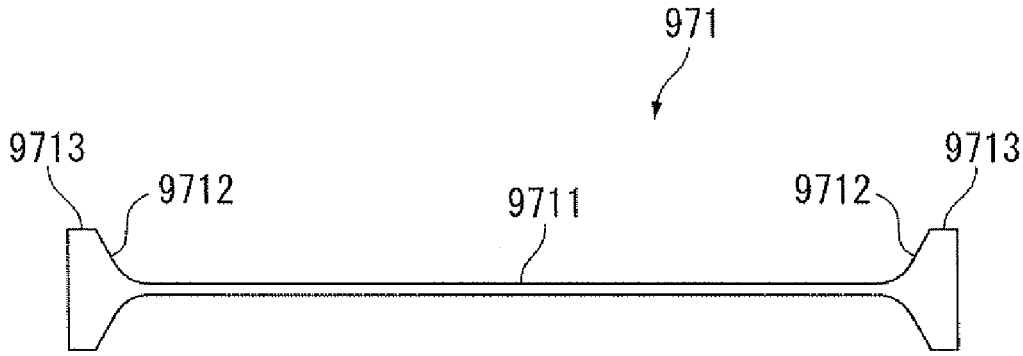
FIG. 8A is a plan view of a male blade according to another modification of the invention.
Figure 8B:
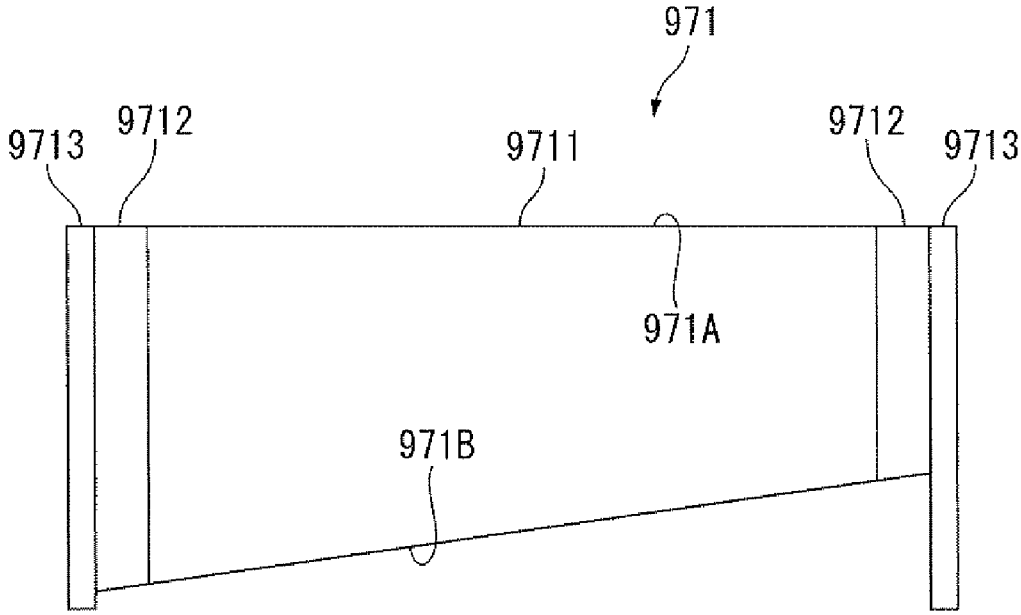
FIG. 8B is a side view of the male blade according to the another modification of the invention.

For instance, in the above exemplary embodiment, the male blade 371 is tapered so that the diameter of the male blade 371 is reduced at every predetermined interval, but the shape is not limited thereto. For instance, as shown in FIGS. 7A and 7B, a linear cutting portion 8711 and a rounded cutting portion 8712 of a male blade 871 may reduce their diameters in a direction toward an upper surface 871A, as a lower surface 871B extends from its center to ends 8713. Alternatively, as shown in FIGS. 8A and 8B, a linear cutting portion 9711 and a rounded cutting portion 9712 of a male blade 971 may reduce their diameters in a direction toward an upper surface 971A, as a lower surface 971B extends from a first end 9713 to a second end 9713.

Figure 9:
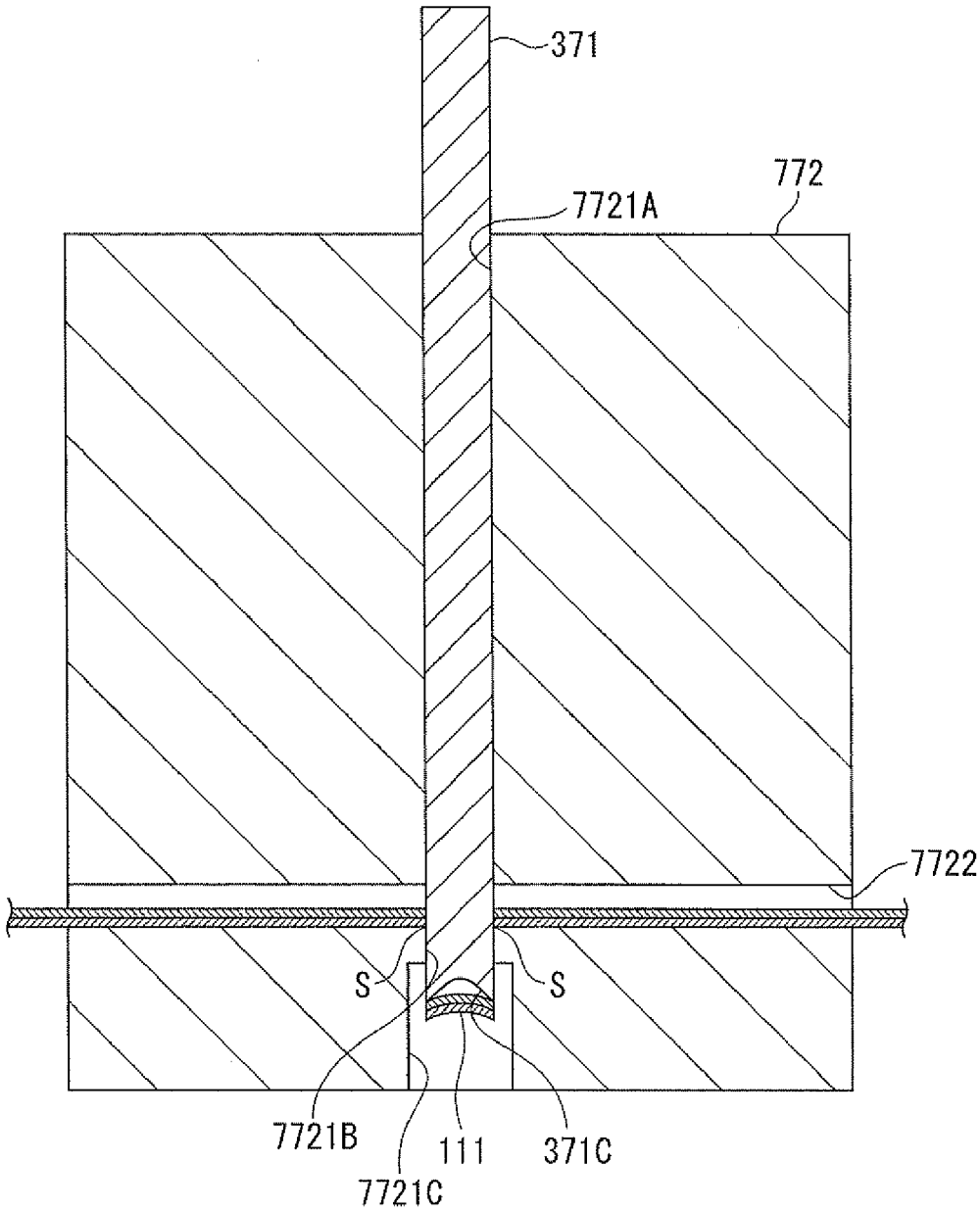
FIG. 9 is a cross sectional view showing how the male blade and the female blade are fitted to each other according to the modification of the invention.
Figure 10A:
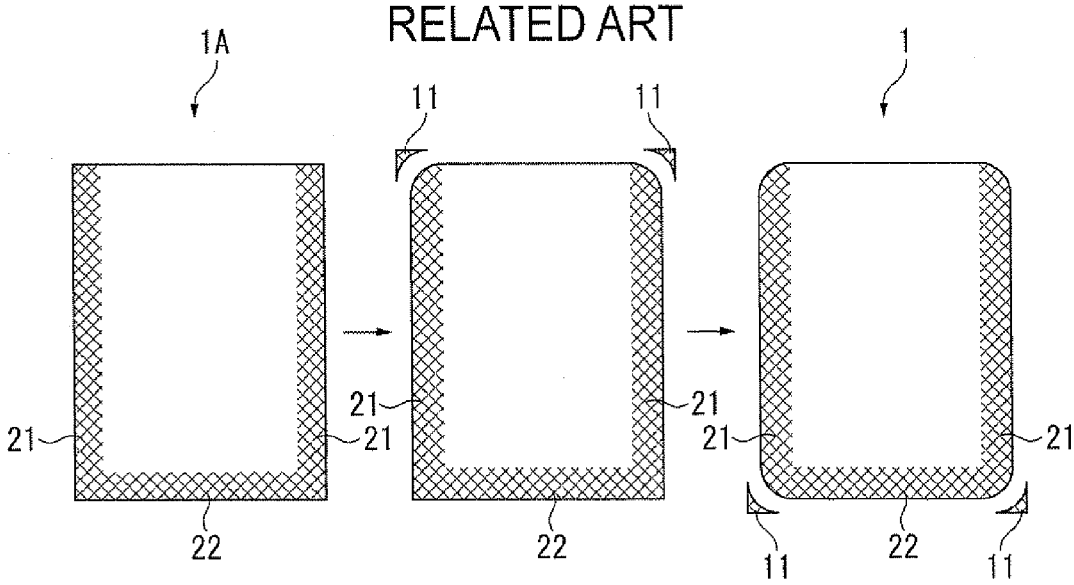
FIG. 10A RELATED ART
FIG. 10A is a schematic view showing a traditional technique.
Figure 10B:
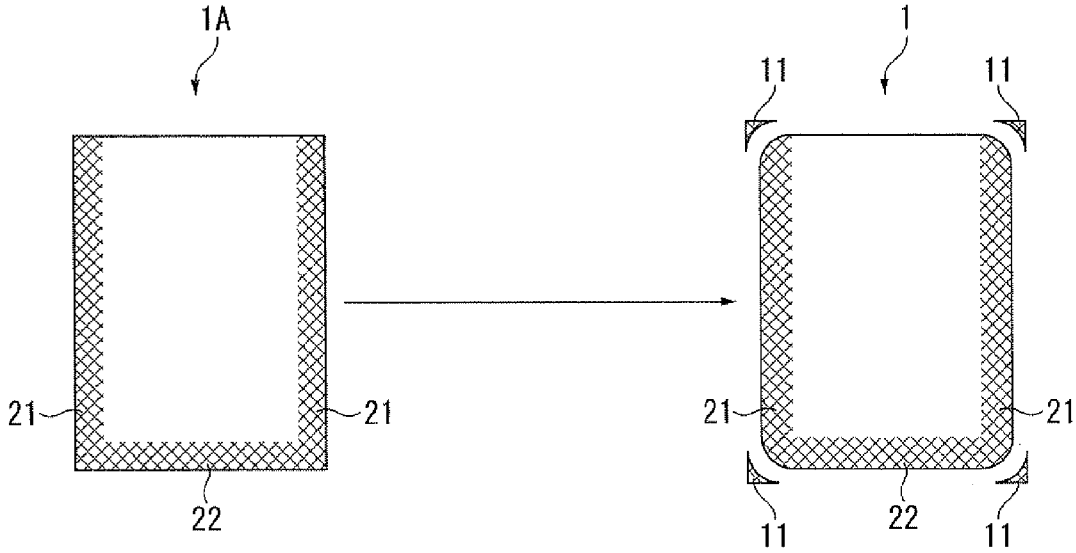
FIG. 10B RELATED ART
FIG. 10B is a schematic view showing the traditional technique.
Figure 11A:
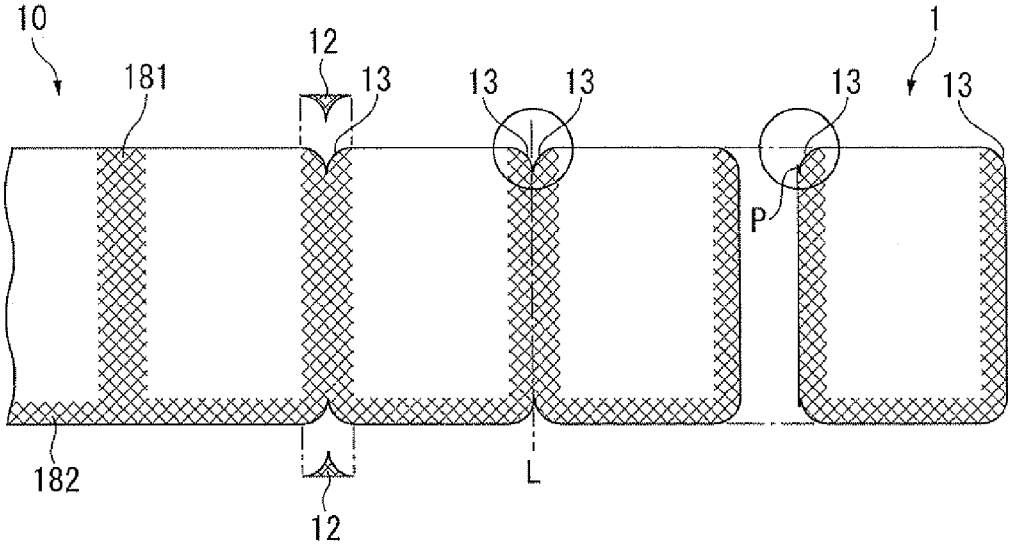
FIG. 11A RELATED ART
FIG. 11A is a schematic view showing a traditional technique.
Figure 11B:
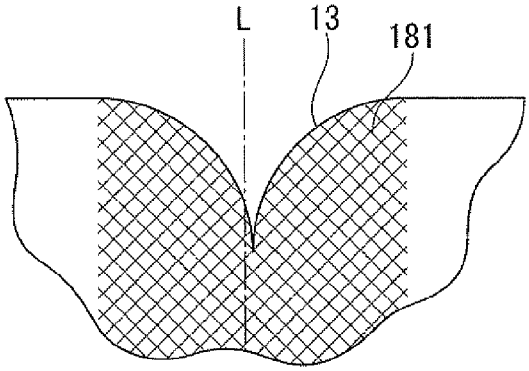
FIG. 11B RELATED ART
FIG. 11B is a schematic view showing the traditional technique.
Figure 11C:
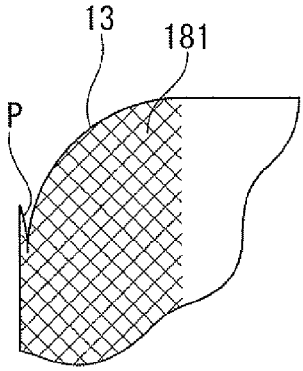
FIG. 11C RELATED ART
FIG. 11C is a schematic view showing the traditional technique.

In the above exemplary embodiment, the wall of the cutting portion 3721E of the female blade 372 is formed so as to entirely contact with the male blade 371 (see FIG. 6). However, as shown in FIG. 9, a wall of a cutting portion 7721B may be formed with a recess 7721C at a position closer to an ejection side of chips apart from cutting points S. In other words, the recess 7721C is configurated not to be in contact with the male blade 371. With this structure, friction between the male blade 371 and the female blade 772 can be freed, thereby improving wear resistance.

A fastener tape, a cut tape and the like may be disposed near the opening 125 inside the packaging bag 100. When such tapes are disposed, the fastener tape and/or the cut tape are introduced at a predetermined position and sealed at the same time when the base film 110 is introduced to the manufacturing device 200. With this manner, the packaging bag provided with fastener tape and/or the cut tape can also provide the above-described advantages.

The invention claimed is:

1. A cutter for a packaging bag, comprising:

a male blade that comprises: a linear cutting portion having a predetermined thickness and substantially linearly shaped in planar view; and a rounded cutting portion substantially arc-shaped in planar view and continuously formed from the linear cutting portion; and a female blade formed in a substantially rectangular parallelepiped and comprising a fitting portion that is formed of the same profile as the male blade and penetrates from one surface to the other opposing surface of the female blade, wherein the female blade comprises an elongated hole penetrating from one lateral surface to the other opposing lateral surface of the female blade, a base film of the packaging bag being adapted to be inserted into the elongated hole from the one lateral surface to the other opposing lateral surface, and wherein the male blade is advanced/retracted along the fitting portion.

2. The cutter for the packaging bag according to claim 1, wherein the linear cutting portion and the rounded cutting portion of the male blade are integrally formed.

3. The cutter for the packaging bag according to claim 1, wherein the elongated hole is perpendicular to the fitting portion, and the fitting portion comprises: a guide portion that guides the male blade; and a cutting portion that is provided adjacent to the guide portion with the insertion portion interposed therebetween.

4. The cutter for the packaging bag according to claim 1, wherein a suction device for sucking a chip produced by the male blade and the female blade is provided on a side of the female blade opposite to a side where the male blade is located.

5. The cutter for the packaging bag according to claim 1, wherein a tip of the male blade is tapered, so that a diameter of the male blade is reduced at every predetermined interval.

6. A manufacturing device of a packaging bag comprising:

a sealer for sealing a base film to form at least one partition; and the cutter for the packaging bag according to claim 1 that receives the base film from the sealer and cuts the at least one partition to form the packaging bag.

7. A manufacturing method of a packaging bag comprising:

using the manufacturing device of the packaging bag according to claim 6, sealing the base film by the sealer to form a partition;

supplying the base film to the female blade of the cutter for the packaging bag; and advancing/retracting the male blade at every partition.

* * * * *